United States Patent [19]

Kronich

[11] Patent Number: 4,662,328

[45] Date of Patent: May 5, 1987

[54] GOVERNOR DRIVEN PUMP FOR AN ENGINE

[75] Inventor: Peter G. Kronich, Sheboygan, Wis.

[73] Assignee: Tecumseh Products Company, Tecumseh, Mich.

[21] Appl. No.: 865,450

[22] Filed: May 21, 1986

Related U.S. Application Data

[62] Division of Ser. No. 797,157, Nov. 12, 1985, Pat. No. 4,648,363.

[51] Int. Cl.[4] ..... F02B 77/00

[52] U.S. Cl. ..... 123/198 C; 123/196 R; 123/508; 123/509; 184/27.1; 418/48

[58] Field of Search ..... 123/196 R, 508, 509, 123/198 C, 195 A; 415/71, 72, 73; 418/48, 149; 184/27.1

[56] References Cited

U.S. PATENT DOCUMENTS

| | | | |
|---|---|---|---|
| 1,986,539 | 1/1935 | Schmidt | 184/6 |
| 2,539,619 | 1/1951 | Goodall | 184/6 |
| 2,621,605 | 12/1952 | Mark, Jr. | 418/48 |
| 2,842,112 | 7/1958 | Philips et al. | 123/196 R |
| 2,951,556 | 9/1960 | Jackson et al. | 184/27.1 |
| 3,037,582 | 6/1962 | Egloff et al. | 184/6 |
| 3,078,958 | 2/1963 | Hoenick | 184/6 |
| 3,088,446 | 5/1963 | Fox et al. | 123/195 A |
| 3,144,097 | 8/1964 | Ebert | 184/13 |
| 3,238,882 | 3/1966 | Ryffel | 418/48 |
| 3,429,304 | 2/1969 | Wiseman et al. | 123/195 A |
| 3,707,202 | 12/1972 | Dixon . | |

OTHER PUBLICATIONS

Litho in U.S.A., 12/76, p. 6.

*Primary Examiner*—E. Rollins Cross
*Attorney, Agent, or Firm*—Jeffers, Irish & Hoffman

[57] ABSTRACT

An internal combustion engine is provided with a lubricating system and a full flow oil filtering circuit arranged in parallel with the main oil lubricating circuit of the engine. The lubricating system includes drive means an oil lubricating circuit for lubricating the drive means, an oil sump connected in flow communication with the lubricating system and an oil pump connected in flow communication with the sump and a lubricating system and operably driven by the drive means for pumping oil from the sump through the lubricating circuit and back to the sump. The parallel flow oil filtering circuit includes an oil filter disposed adjacent the oil sump and connected in flow communication therewith. An oil pump is disposed adjacent the sump and connected in flow communication with the sump and the oil filtering means. The oil pump is driven by engagement with the governor gear.

6 Claims, 6 Drawing Figures

GOVERNOR DRIVEN PUMP FOR AN ENGINE

This is a division of application Ser. No. 797,157, filed Nov. 12, 1985, now U.S. Pat. No. 4,648,363.

BACKGROUND OF THE INVENTION

1. Field of the Invention

The present invention relates generally to lubrication systems for internal combustion engines and, more particularly, to an arrangement for filtering the oil in an engine lubricating system wherein the flow circuit including the filter is separate from the lubrication flow circuit of the system.

2. Description of the Prior Art

Oil lubrication systems for lubricating the working components of an internal combustion engine are most effective and the life of the oil is extended as long as the oil remains clean. However, it is to be expected, that the oil will pick up impurities such as metal and dirt particles as the oil circulates about the lubricating system. This is especially true in dusty environments in which many small engines are used such as, for instance, in lawn mowers and the like. If such impurities are permitted to remain in the oil they will cause premature wear of the working components of the engine. Furthermore if such impurities remain in the oil they will tend to clog the circulation flow passages of the lubrication system, thereby preventing sufficient oil from reaching the working components of the engine, and contributing further to engine wear.

Thus, in order to avoid premature wear of the working components of the engine, it is necessary to remove these impurities or otherwise change the oil frequently. Since changing the oil in engines is time consuming, it is desirable that an oil filtering system is provided. Prior art engines have been provided which include systems for removing impurities from lubricating oil. Both oil separating and filtering techniques have been provided in such prior art arrangements. Examples of oil separating systems are disclosed in U.S. Pat. Nos. 3,078,958 and 1,986,539. A disadvantage of such separating systems is the relative complexity of the systems and the need to periodically clean the oil separators to remove the impurities therefrom. Furthermore, such systems are not as effective to remove impurities from the oil as are filtering systems because they depend upon the centrifugal separation of impurities from the oil rather than on removing the impurities with a positive filtering barrier or oil filter element in the filtering circuit for positively preventing impurities from remaining entrained in the circulating oil. It is therefore desirable that lubricating oil is filtered to remove the impurities therein.

Small internal combustion engines, such as used on lawn mowers and other small tools and implements, are generally splash or pressure spray lubricated. Such splash or pressure spray lubrication systems are not compatible with a filtration system arranged in series with the lubrication system because, during normal operation, insufficient or no oil pressure is available for operating a satisfactory oil filtering system and lubricating the engine. In general, the lubrication pumps used in those systems are positive displacement pumps such as plunger or gyrator type of pumps which, on start-up at lower temperatures with high oil viscosities, will cause high oil pressure to be generated which will cause the oil filter element to fail unless a pressure relief valve is added to the system.

An additional problem encountered in small engines is that the oil filters used therein tend to be relatively small, thereby clogging rather quickly and preventing oil flow from lubricating the engine if the filter is located in the main lubrication flow circuit. Accordingly many small engines have been provided without any oil filtration system, thereby causing excessive engine wear and resulting in the need for frequent oil changes. It is therefore desired to provide a lubrication system for a small engine including an oil filtering circuit which is economical to manufacture and install in small internal combustion engines.

SUMMARY OF THE INVENTION

The present invention overcomes the problems of the prior art oil lubrication systems by providing a full flow oil filtering system which forms an independent flow circuit separate from the engine lubrication system. By using a screw type oil pump rotatably mounted on the support shaft of the engine governor and driven by the governor gear, an oil pump is provided for use with the separate full flow oil filtration system. With the oil screw-type pump in the full flow oil filtration system, even with high viscosity oil, no great start-up differential in pressure is developed and therefore no pressure relief is required in the parallel flow filtration system circuit. The filtering system advantageously can be provided as an add-on to the basic engine with only minor-changes in the present tooling of the engine. The separate full flow filtration system is effective yet simple in design and low in cost.

An advantage of the lubricating oil filtration system of the present invention is the increased life of the engine.

An additional advantage of the oil filtration system according to the present invention that it reduces engine wear.

A yet further advantage of the lubrication system of the present invention is that it permits increased time intervals between oil changes.

Still a further advantage of the present lubricating system is that there will be no adverse effects on the engine during cold starts due to the pressure viscosity relation of the screw type oil pump.

Another advantage of the parallel flow lubrication oil filtration system according to the present invention is that, if the operator permits the filter to clog, oil will continue to be circulated through the engine for the lubrication thereof because the filtration system comprises a separate flow circuit.

Still another advantage of the filtration system according to the present invention is its simplicity and cost effectiveness.

The present invention, in one form thereof, comprises a parallel full flow oil filtering system for an engine lubrication system and including a drive means, an oil sump, and a governor for controlling the throttle of the engine. The governor includes a housing disposed adjacent the oil sump and driven means disposed above the housing and drivingly interconnected with the drive means of the engine. The parallel flow oil filtering flow circuit includes an oil inlet means defined in the housing and in flow communication with the oil sump, an outlet means defined in the housing, an oil discharge tube interconnecting an oil inflow orifice to an oil filtering means and an outflow orifice from the oil filtering means in communication with the oil sump. An oil pump is mounted in the housing and is drivingly interconnected with the governor driven means such that, upon being driven by the governor driven means, the pumping means causes oil flow from the sump into the housing by the inlet means and by the separate oil filtering system flow circuit from the housing through the oil filtering means and back to the sump.

More particularly, the oil pumping means is a screw-type member rotatably mounted on a support shaft of the governor and drivingly coupled to a gear of the governor which is also rotatably supported on the support shaft and is located above the screw-type member. The governor gear includes an outer rim containing drive elements, an inner hub and a plurality of circumferentially spaced and radially extending ribs interconnecting the outer rim and inner hub. The screw type pumping member includes a plurality of flanges mounted on its upper end which fit between the radial ribs of the governor gear for drivingly interconnecting the gear and the pumping member together.

The present invention, in one form thereof, comprises an internal combustion engine including an oil lubricating system having a drive means and an oil lubricating circuit. The system further includes an oil sump connected in flow communication with the lubricating circuit. A first oil pump means is connected in flow communication with the sump and the lubricating circuit and is operably driven by the drive means for pumping oil from the sump through the lubricating circuit and back to the sump. An oil filter circuit is disposed in parallel to the oil lubricating circuit and the filtering system and includes an oil filtering means disposed adjacent the oil sump and connected in flow communication therewith. A second oil pump means is mounted in the sump and is connected in flow communication with the sump and the oil filtering means and is operably driven by the drive means for pumping oil from the sump to the oil filtering means and back to the sump.

The present invention, in one form thereof, furthermore provides an oil filtering system for an engine including a drive shaft and an oil lubricating system for the engine including an oil sump and a governor for controlling the throttle of the engine. The governor includes driven means drivingly interconnected with the drive shaft. The oil filtering system comprises a housing, an oil inlet means defined in the housing in flow communication with the oil sump, and oil outlet means defined in the housing and an oil filtering means disposed adjacent the oil sump and having an inflow orifice and and an outflow orifice. An oil filtering flow circuit, separate from the oil lubrication system of the engine, is provided for interconnecting the oil outlet means of the housing and the oil inflow orifice and further interconnecting the outflow orifice and the oil sump. Oil pump means is mounted in the housing and is drivingly interconnected with the governor driven means such that, upon being driven by the governor driven means, the pumping means causes oil flow from the sump into the housing by the inlet means and from the housing through the oil filtering means and back to the sump.

It is an object of the present invention to provide an oil lubrication system including a full flow oil filtering circuit which is separate from and in parallel with the main lubrication circuit.

It is another object of the present invention to provide an oil filtering system for an engine including a replaceable filter element.

It is a still further object of the present invention to provide an oil filtering circuit including an oil pump which is driven by the throttle governor drive gear.

A yet further object of the present invention is to provide an oil filtering circuit for a small internal combustion engine including a screw type pump operated by the governor throttle drive and providing for oil flow in a circuit separate from the main lubrication circuit.

Yet another object of the present invention is to provide an oil filtration system for a small internal combustion engine which will not cause engine gasket problems during cold starts.

A yet further object of the present invention is to provide an oil filtration system which is effective yet economical to construct.

BRIEF DESCRIPTION OF THE DRAWINGS

The above mentioned and other features and objects of this invention and the manner of obtaining them will become more apparent in the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
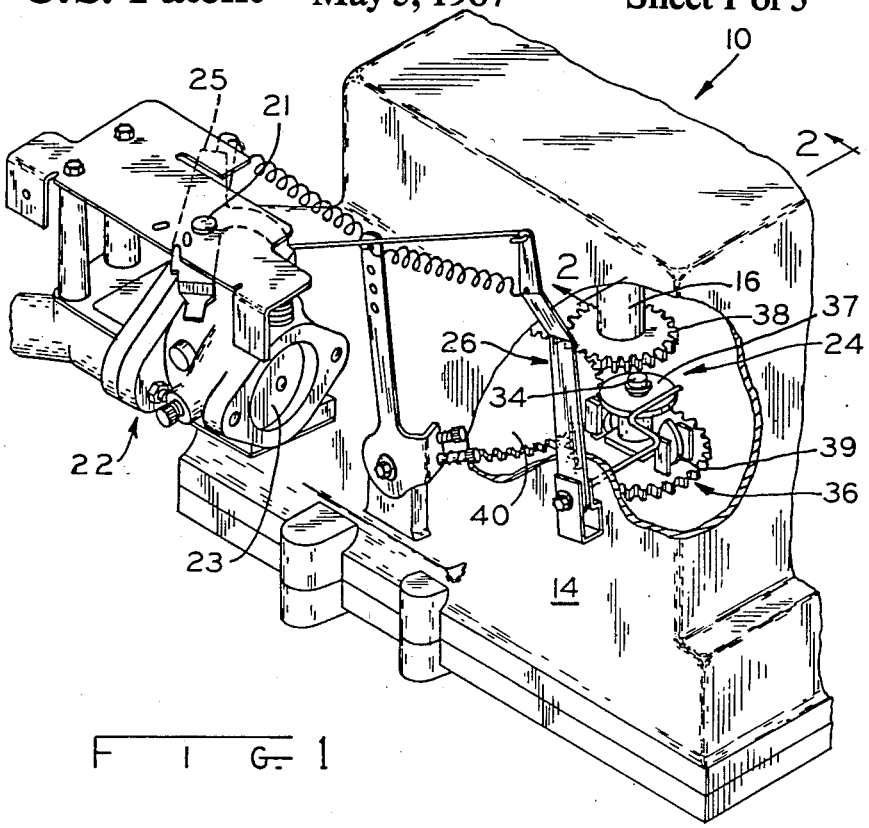
FIG. 1 is a perspective view of a conventional small internal combustion engine with which the lubricating oil filtration system of the present invention may be employed.
Figure 2:
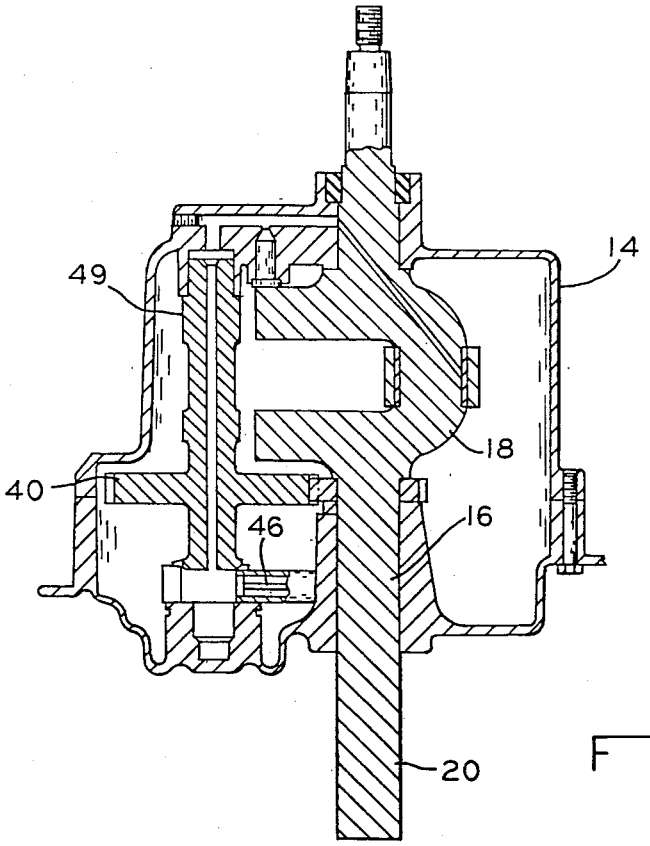
FIG. 2 is an enlarged elevational view, partly in cross section, of the engine block taken along line 2—2 of FIG. 1 with the engine governor removed to fully expose the central vertical drive shaft and other components associated with the drive shaft for driving the main oil pump and engine governor shown in FIG. 1.
Figure 4:
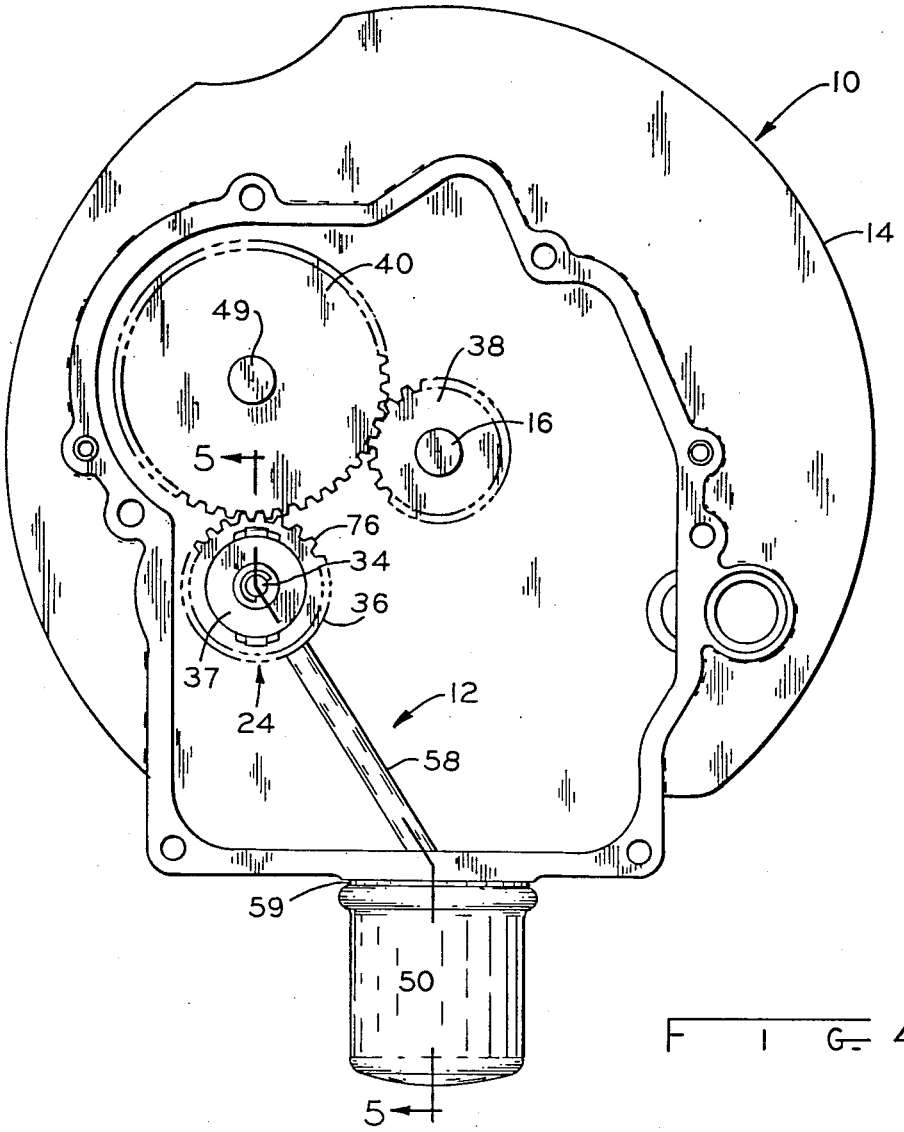
FIG. 4 is a top plan view of the internal combustion engine of FIG. 1 employing the lubrication oil filtration system of the present invention with an upper portion of the engine block removed.
Figure 5:
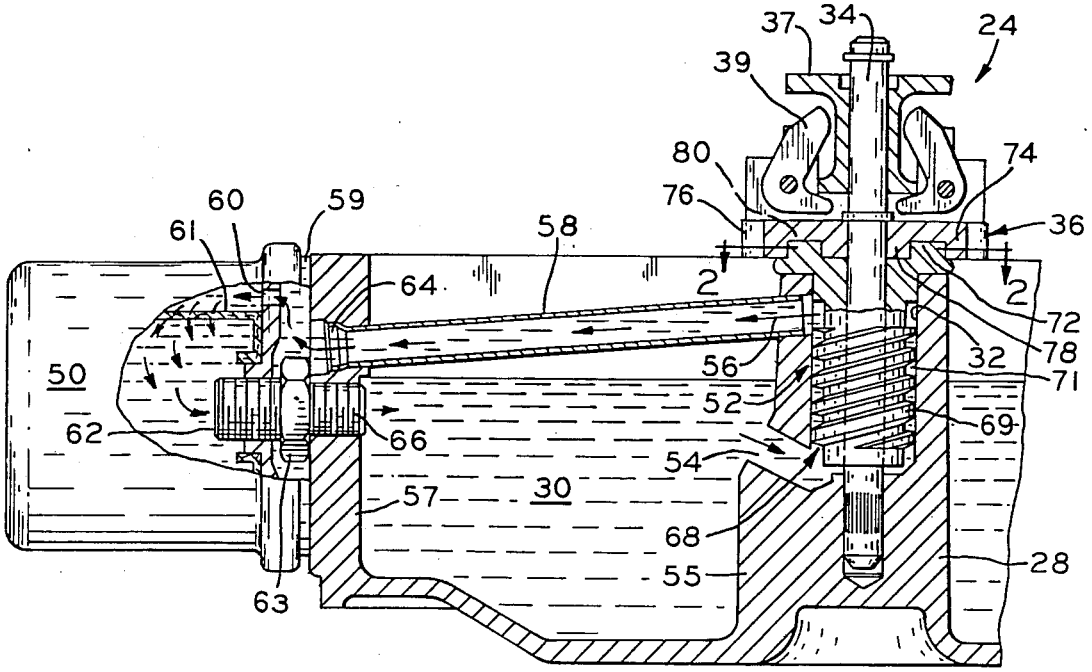
FIG. 5 is an enlarged fragmentary elevational view, taken along line 5—5 of FIG. 4 partly in cross-section, with portions broken away.

Referring now to the drawings and particularly to FIGS. 1 and 2, there is shown the portion of a conventional small internal combustion engine, generally designated 10, which includes the components with which the lubricating oil filtration system 12, as shown in FIGS. 4 and 5, may be employed.

Engine 10 typically includes a main casting or block 14 which houses and rotatably supports a vertically oriented crankshaft or drive shaft 16 having an off-set portion 18 which, via a connecting rod (not shown), is joined to a piston (not shown) which is mounted for reciprocable movement within a cylinder (not shown) in the engine block 14. The reciprocable motion of the piston is translated into rotary motion of the drive shaft 16 due to the interconnection of the piston with the off-set shaft portion 18 by the connecting rod. Drive shaft 16 includes an output end 20 to which is attached a motion transmitting device (not shown), such as a gear, pulley, or the like for connection to a device such as a mower and the like for performance of useful work.

As is well known, the reciprocatory speed of the piston, and therefore the rotational speed of drive shaft 16, are determined by the rate at which a combustable fuel-air mixture is fed to the cylinder (not shown) via a carburetor 22 of the engine. As conventionally practiced, engine 10 has a governor 24 driven by drive shaft 16 which controls a throttle valve (not shown) mounted on a shaft 21 in carburetor 22. The throttle valve regulates the feed rate at which the combustable fuel-air mixture is fed to the cylinder. A choke valve 23 is also provided for determining the fuel to air ratio of the mixture of which is fed to the cylinder. The maximum speed at which the engine runs is controlled by adjustment of a hand throttle control lever 25 which is connected to throttle valve shaft 21. The operation of the carburetor is conventional and forms no part of the present invention and therefore need not be further explained herein.

Governor 24 is rotatably driven by drive shaft 16 and regulates the throttle valve (not shown) through a conventional linkage 26 to maintain constant the rate at which the combustable fuel-air mixture is fed to the cylinder for a specific setting of the throttle control, under various engine loading conditions. The governor operates on the basis of centrifugal speed for maintaining constant the rotational speed of the engine. The operation of the throttle control governor is also conventional, forms no part of the instant invention, and is therefore not explained further herein.

Throttle governor 24, as seen in FIG. 5, includes a support housing 28 which is located adjacent and oil sump 30 of engine 10 and defines a hollow cavity 32. Governor 24 further includes a support shaft 34 mounted within housing 28 and extending generally centrally of cavity 32 and upwardly above it. Additionally, governor 24 includes a driven gear 36 rotatably mounted on support shaft 34 above housing 28. As is conventional, governor 24 includes a spool member 37 which is operated by two lugs 39 mounted for pivotable movement on driven gear 36. As driven gear 36 rotates, centrifugal force will cause lugs 39 to pivot outwardly thereby causing spool 37 to be lifted upwardly to operate linkage 26 thereby. As best seen in FIG. 4, governor driven gear 36 is drivingly interconnected with drive gear 38 carried on drive shaft 16 of the engine via an intermediate larger diameter gear 40.

Figure 3:
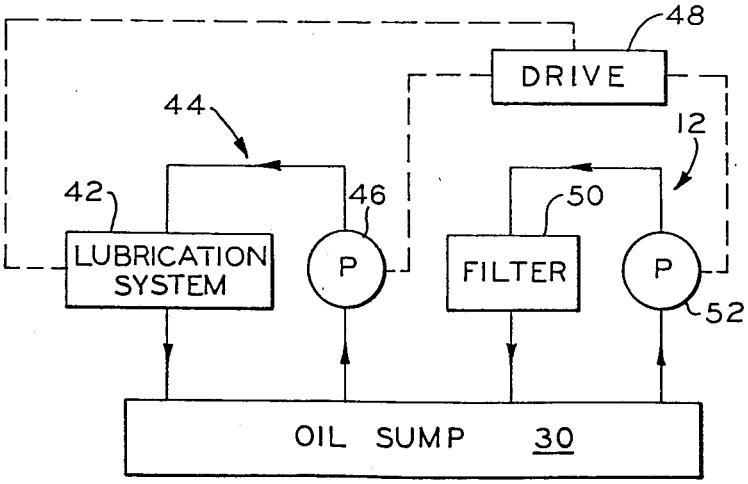
FIG. 3 is a block diagram of the flow circuit arrangement of the oil filtration system of the present invention in combination with the oil lubrication circuit of the engine.

Referring now to FIG. 3, it is shown diagrammatically that oil sump 30 serves as the main oil reservoir for an oil lubricating system 42 in the main oil lubricating circuit, generally designated 44, of engine 10. Further, oil filtering circuit 12 of the present invention is shown disposed in parallel circuit arrangement with main oil lubricating circuit 44 and connected in flow communication with oil sump 30 of engine 10.

Main oil lubricating circuit 44 includes a main oil pump 46 driven by drive means 48 which includes engine drive shaft 16, intermediate gear 40, and cam shaft 49. As best seen in FIG. 2 pump 46 preferably comprises a barrel type of lubrication pump. However, it should be understood that other types of pumps may be substituted for barrel type pump 46. Oil lubricating system 42, which may be provided by any number of suitable conventional arrangements, lubricates drive means 48 as represented by the dashed line connecting drive means 48 with lubrication system 42. Oil sump 30 is connected in flow communication with lubricating system 42. Main oil pump 46 is connected in flow communication with sump 30 and lubricating system 42. Therefore, as main pump 46 is driven by drive means 48, as indicated by the dashed line connecting the two, oil is pumped from sump 30 through circuit 44 to lubricating system 42 and back to the sump.

Oil filtering system 12 of the present invention, being connected to oil sump 30 in parallel with main oil lubricating circuit 44, includes an oil filtering means 50 in the form of a replaceable oil filter element disposed adjacent oil sump 30 and connected in flow communication therewith. Oil filtration circuit 12 further includes an oil pump 52 mounted in cavity 32. Pump 52 is connected in flow communication with sump 30 and oil filter element 50 and is operably driven by drive means 48 as represented by the dashed line connecting drive means 48 and pump 52. As pump 52 is driven, oil is pumped from sump 30 to oil filter element 50 and back to sump 30.

Turning now to FIGS. 4 and 5, oil filtering system 12 of the present invention is illustrated in operative association with the throttle control governor 24 of engine 10. In the preferred embodiment, oil filtering system 12 includes an oil inlet 54 comprising a passage through the sump wall 55 and into a lower portion of support housing 28 to provide flow communication between cavity 32 and oil sump 30. An oil outlet passage 56 through wall 55 of an upper portion of support housing 28 provides flow communication between cavity 32 and an oil filter element 50. An oil discharge tube 58 interconnects support housing oil outlet 56 in flow communication with oil filter element 50 which is mounted to a wall 57 of sump 30 by a filter adapter plate 59.

Adapter plate 59 is retained to exterior of wall 57 of sump 30 by a threaded nipple 66 with a nut 63. An "O" ring seal (not shown) is trapped between sump wall 57 and filter adapter plate 59 to seal the adapter plate 59 to wall 57. Ferrule 64 is pressed into a drilled hole in the sump wall 57 and is connected to discharge tube 58 and feeds contaminated oil through aperture 60 to the outside of filter member 61 of filter element 50. The oil then flows through filter element member 61 to the center of filter element 50 and out of an outflow orifice 62 in nipple 66 to sump 30. Nipple 66 is threaded into the sump wall 57 and retains filter element 50 in place by threaded engagement therewith.

Figure 6:
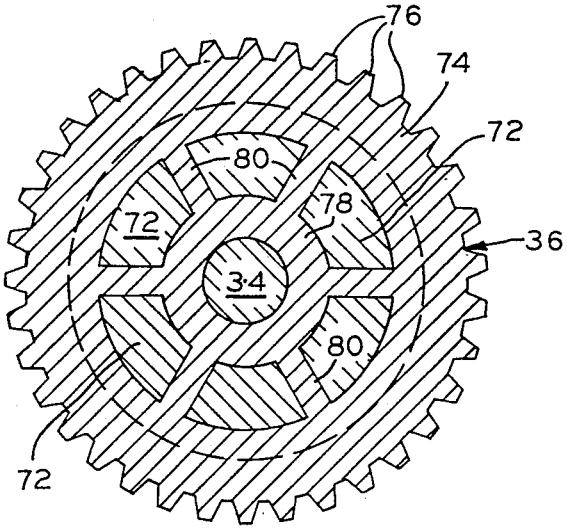
FIG. 6 is an enlarged plan view of the driven gear of the engine governor.

Oil pump 52 of filtering system 12 utilizes a portion of the throttle control governor 24 of engine 10. In particular pump 52 includes a screw type rotor 68 disposed in cavity 32 and having helical threads 69 and forming a helical passage 71 with the wall of cavity 32. Threads 69, in the preferred embodiment, are square and have a pitch of 8 threads per inch. Rotor 68 is preferably constructed of molded plastic. The top thread of rotor 68 is removed to form a circumferential groove in cavity 32 adjacent oil outlet 56. Helical screw 68 is rotatably mounted on support shaft 34 of governor 24 below driven gear 36 of the governor. Gear 36 is drivingly connected to pump screw rotor 68. The driving interconnection between gear 36 and rotor 68 includes a plurality of tangs or teeth 72 formed on the upper end of pumping screw rotor 68. As best seen in FIG. 6 driven gear 36 includes an outer rim 74 having drive gear teeth 76 formed thereon. Gear 36 further includes an inner hub 78 spaced inwardly from outer rim 74 for rotatably mounting gear 36 on the governor support shaft 34. A plurality of circumferentially spaced and radially extending ribs 80 interconnect outer rim 74 and inner hub 78. Tangs 72 of screw rotor 68 fit between radial ribs 80 of governor gear 36 for drivingly interconnecting gear 36 and pump rotor 68.

In operation, when engine 10 is operating and governor driven gear 36 is rotated, pump screw rotor 68 is rotatably driven by gear 36 and causes oil to flow through inlet 54 into cavity 32. Helical passage 71 will carry the oil upwardly and will discharge the oil through outlet 56 and discharge tube 58 to flow into filter element 50 via orifice 60. After proceeding through oil filter element 50, where impurities are filtered from the oil by filter element member 61, the oil flows though outlet 62 in nipple 66 and then back to oil sump 30.

Filter element 50 should be replaced periodically as it will become clogged with impurities. However, it should be noted that, even if filter element 50 becomes clogged with impurities and flow therethrough is inhibited, oil will still be circulated through the main lubrication system of the engine via lubricating circulating circuit 44 since filtering system 12 is arranged in parallel with lubrication circuit 44. It should also be noted that, while oil pump 52 is described as comprising a screw type of pump, other types of pumping mechanisms could be substituted therefor.

While this invention has been described as having a preferred design, it will be understood that it is capable of further modification. This application is therefore intended to cover any variations, uses, or adaptations of the invention following the general principles thereof and including such departures from the present disclosure as come withing known or customary practice in the art to which this invention pertains and fall within the limits of the appended claims.

What is claimed is:

1. An oil pump for pumping engine lubricating oil in an internal combustion engine, said engine including a governor, said pump including:

a support shaft adapted to be driven by said governor;

a helical screw member supported on said support shaft; and a cylindrical chamber having a diameter slightly greater than the diameter of said helical screw member, said chamber having an inlet and an outlet for receiving and delivering engine lubricating oil, said helical screw member being disposed in said chamber.

2. The oil pump according to claim 1 wherein said governor includes a driving gear, said gear being secured to said support shaft.

3. The oil pump according to claim 1 wherein said governor includes a driving gear, said gear being drivingly associated with the governor shaft, said gear further being drivingly associated with said helical screw member.

4. The oil pump according to claim 1 wherein said helical screw member includes a flanged member, said helical screw member being rotatably journalled on said support shaft, said flanged member including at least one upstanding tooth, said at least one upstanding tooth being drivingly associated with a driving member which rotatingly drives said governor.

5. The oil pump according to claim 4 wherein said flanged member supports said helical screw member against downward movement in said chamber.

6. The oil pump according to claim 1 wherein said governor includes a driving gear, said gear being secured to the governor shaft, said gear including an outer rim having drive elements located around its periphery, said gear further including an inner hub spaced inwardly from said outer rim and including a plurality of circumferentially spaced and radially extending ribs which interconnect said outer rim and said inner hub;

said helical screw member being rotatably journalled on said support shaft and having a plurality of upstanding teeth mounted on its upper end, said plurality of teeth respectively located in the spaces between said radially extending ribs of said driving gear for drivingly interconnecting said gear and said helical screw member.

* * * * *